US009452310B2

(12) United States Patent
Broffman

(10) Patent No.: US 9,452,310 B2
(45) Date of Patent: Sep. 27, 2016

(54) STANDUP PADDLE BOARD CORE ACTIVATOR

(71) Applicant: Jeffery Alan Broffman, Sebastopol, CA (US)

(72) Inventor: Jeffery Alan Broffman, Sebastopol, CA (US)

( * ) Notice: Subject to any disclaimer, the term of this patent is extended or adjusted under 35 U.S.C. 154(b) by 1 day.

(21) Appl. No.: 14/454,813

(22) Filed: Aug. 8, 2014

(65) Prior Publication Data

US 2016/0038782 A1 Feb. 11, 2016

(51) Int. Cl.

*A63B 69/06* (2006.01)
*A63B 21/00* (2006.01)
*A63B 21/055* (2006.01)
(Continued)

(52) U.S. Cl.

CPC ... *A63B 21/00065* (2013.01); *A63B 21/00072* (2013.01); *A63B 21/023* (2013.01); *A63B 21/0421* (2013.01); *A63B 21/055* (2013.01); *A63B 21/068* (2013.01); *A63B 21/1469* (2013.01); *A63B 21/4033* (2015.10); *A63B 21/4035* (2015.10); *A63B 21/4045* (2015.10); *A63B 22/0023* (2013.01); *A63B 23/03525* (2013.01); *A63B 23/1209* (2013.01); *A63B 69/06* (2013.01); *A63B 21/008* (2013.01); *A63B 21/0552* (2013.01); *A63B 23/0205* (2013.01); *A63B 2069/064* (2013.01); *A63B 2208/0204* (2013.01); *A63B 2225/093* (2013.01)

(58) Field of Classification Search

CPC ..... A63B 2022/0079–2022/0084; A63B 2022/0089; A63B 22/0002–22/0012; A63B 22/0046; A63B 2208/0204; A63B 2022/0647; A63B 21/068; A63B 21/023; A63B 21/04; A63B 21/0421; A63B 21/0435; A63B 21/0442; A63B 21/055; A63B 22/0023; A63B 22/0076; A63B 22/20; A63B 22/201; A63B 22/203; A63B 22/205; A63B 69/06; A63B 2069/062; A63B 2069/064; A63B 2069/066; A63B 2069/068

See application file for complete search history.

(56) References Cited

U.S. PATENT DOCUMENTS 1,707,791 A 4/1925 Anderson
3,528,653 A * 9/1970 Ross ..... A63B 21/015 482/118

(Continued)

OTHER PUBLICATIONS

Notification of Transmittal of the International Search Report and the Written Opinion of the International Searching Authority, or the Declaration, dated Oct. 16, 2015, in connection with corresponding International Application No. PCT/US2015/042625, filed Jul. 29, 2015 (9 pgs.).

(Continued)

*Primary Examiner* — Oren Ginsberg
*Assistant Examiner* — Gregory Winter
(74) *Attorney, Agent, or Firm* — Maier & Maier, PLLC

(57) ABSTRACT

A standup paddle board core activator and method of use may include a sloped platform, a sliding footboard, two raised support structures incorporating at least two axles, two rotating arm assemblies, two paddle members with shafts and handles, a tensioner support structure and two tensioners. The sliding footboard may be configured to move along the sloped platform. The rotating arm assemblies may be rotatably attached by axles to raised support structures on either side of the sloped platform. Tensioners may connect to a tensioner support structure and the rotating arm assemblies, applying resistance to the rotation of the arm assemblies about an axis created by the axles. Paddle members may be inserted in the arm assemblies. A user may balance on the footboard, grasp at least one paddle member, and slide the footboard up the sloped platform.

8 Claims, 6 Drawing Sheets

(51) Int. Cl.

| | |
|---|---|
| ***A63B 22/00*** | (2006.01) |
| ***A63B 21/02*** | (2006.01) |
| ***A63B 21/04*** | (2006.01) |
| ***A63B 21/068*** | (2006.01) |
| ***A63B 23/035*** | (2006.01) |
| ***A63B 23/12*** | (2006.01) |
| *A63B 21/008* | (2006.01) |
| *A63B 23/02* | (2006.01) |

(56) References Cited

U.S. PATENT DOCUMENTS

| | | | | |
|---|---|---|---|---|
| 4,813,667 | A * | 3/1989 | Watterson | A63B 21/023 482/112 |
| 4,966,364 | A | 10/1990 | Eggenberger | |
| 5,441,469 | A * | 8/1995 | Chern | A63B 22/0076 482/72 |
| 5,597,375 | A * | 1/1997 | Simonson | A63B 23/1254 482/100 |
| 5,957,817 | A | 9/1999 | Koenig et al. | |
| 6,514,180 | B1 * | 2/2003 | Rawls | A63B 21/005 482/51 |
| 6,533,709 | B1 | 3/2003 | Jones | |
| 7,232,404 | B2 | 6/2007 | Nelson | |
| 7,572,211 | B2 * | 8/2009 | Roach | A63B 22/0076 482/51 |
| 7,731,637 | B2 * | 6/2010 | D'Eredita | A63B 21/154 482/138 |
| 7,775,936 | B2 | 8/2010 | Wilkinson | |
| 9,005,086 | B1 * | 4/2015 | O'Neil | A63B 22/0076 482/51 |
| 2010/0048367 | A1 * | 2/2010 | Liang | A63B 21/154 482/130 |
| 2011/0275489 | A1 | 11/2011 | Apau | |
| 2013/0017932 | A1 | 1/2013 | Tayebi | |
| 2013/0045841 | A1 * | 2/2013 | Chen | A63B 69/18 482/71 |
| 2013/0225374 | A1 | 8/2013 | Lumsden et al. | |
| 2014/0213127 | A1 | 7/2014 | Bonner et al. | |
| 2014/0221169 | A1 | 8/2014 | Bourne et al. | |

OTHER PUBLICATIONS www.blueplanetsurf.com; Paddle Core Trainer with three piece Aluminum Paddle; dated Jun. 9, 2014.

* cited by examiner

STANDUP PADDLE BOARD CORE ACTIVATOR

BACKGROUND

Standup paddle surfing, also referred to as standup paddle boarding, is a popular water sport. Standup paddle boards are used for many recreational activities, including exploring bodies of water, racing, riding waves, fishing, yoga, and other forms of exercise. One of its many benefits is excellent abdominal core strengthening.

However, to partake in standup paddle surfing, one must have access to a body of water. Additionally, uncontrollable factors, such as weather must cooperate. These burdens limit a person's ability to enjoy the benefits of standup paddle surfing. Eliminating such burdens would offer the benefits to many more people.

SUMMARY

A standup paddle board core activator may be provided. One embodiment may include a sloped platform, a sliding footboard, two raised support structures, at least two axels, two rotating arm assemblies, two paddle members with shafts and handles, a tensioner support structure and two tensioners. The sliding footboard may be configured to move along the sloped platform. The rotating arm assemblies may be rotatably attached by axles to raised support structures on either side of the sloped platform. Tensioners may connect a tensioner support structure and the rotating arm assemblies, applying resistance to the rotation of the arm assemblies about an axis created by the axles. The paddle members may be adjustably affixed to the arm assemblies.

BRIEF DESCRIPTION OF THE FIGURES

Advantages of embodiments of the present invention will be apparent from the following detailed description of the exemplary embodiments. The following detailed description should be considered in conjunction with the accompanying figures.

Exemplary

Exemplary

Exemplary

Exemplary

Exemplary

Exemplary

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a standup paddle board core activator device may be provided.

Figure 1:
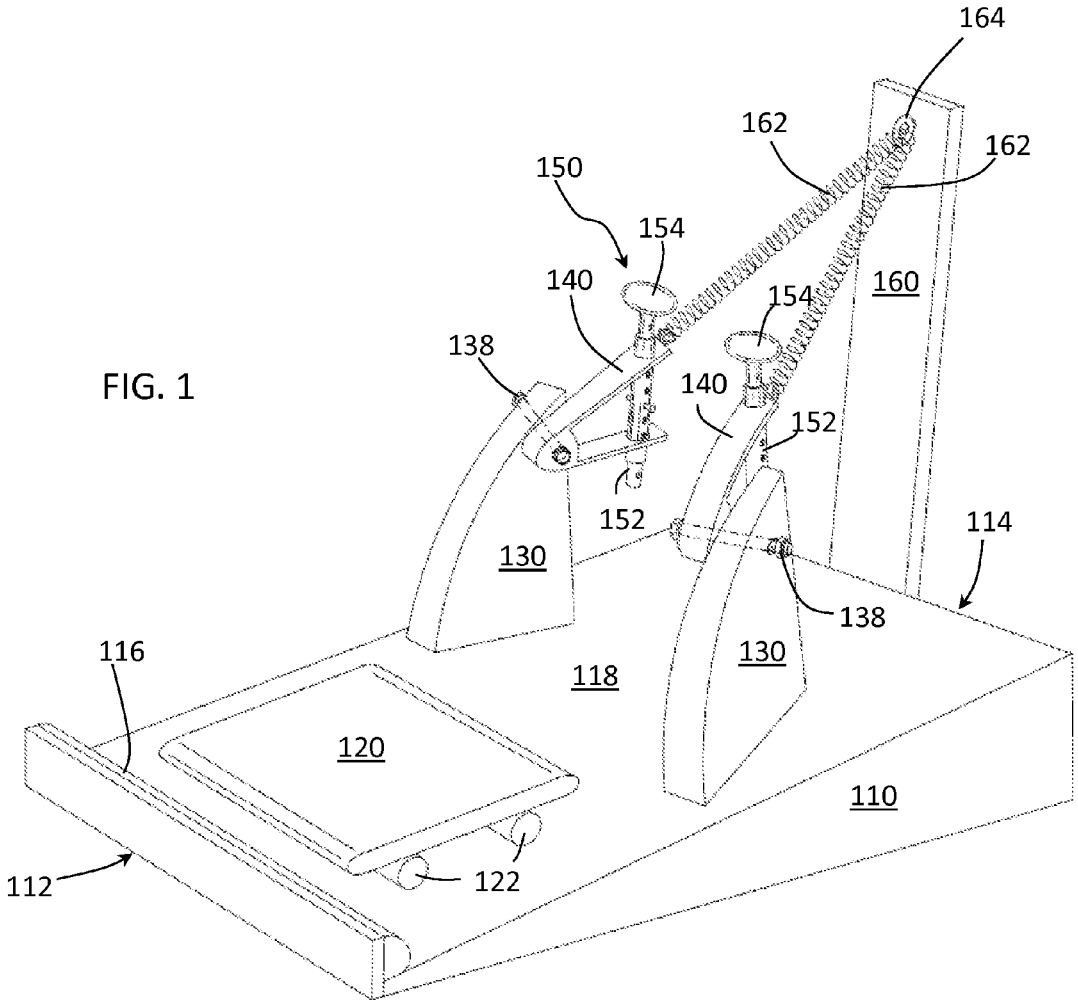
FIG. 1 shows a perspective view of an exemplary embodiment of a standup paddle board core activator.

Generally referring to FIG. 1, an exemplary embodiment of a standup paddle board core activator may include a sloped platform 110, a sliding footboard 120, two raised support structures 130, at least two axels 138, two rotating arm assemblies 140, two paddle members 150 with shafts 152 and handles 154, a tensioner support structure 160 and two tensioners 162.

Sloped platform 110 may be substantially rectangular and may be configured such that an incline is formed from posterior edge 112 to anterior edge 114. In an exemplary embodiment, sloped platform 110 may be about 28 inches to about 36 inches wide and approximately 48 inches long. The sloped platform 110 may be sized and shaped in a variety of ways, as would be understood by a person having ordinary skill in the art. Sloped platform 110 may serve as an independent support structure for activator 100, or alternatively may be configured within a separate frame 170 (shown in FIGS. 2-4). Sloped platform 110 may be fixed or adjustable. In a fixed embodiment, sloped platform 110 may be substantially wedge shaped and may have a fixed incline. In adjustable embodiments, the incline of sloped platform 110 may be configured to increase or decrease. The mechanism for increasing or decreasing the incline may include a variety of mechanisms as would be known by a person having ordinary skill in the art, such as hydraulics, adjusting pins, adjustable legs, or simply adding or removing material below sloped platform 110. In exemplary embodiments where sloped platform 110 serves as an independent support structure, sloped platform 110 may have a raised backstop 116, which may be disposed along posterior edge 112. Backstop 116 may be configured to retain a footboard 120 on sloped platform 110. In an exemplary embodiment, backstop 116 may include a rubber bumper for contacting footboard 120. There may additionally be a stop along anterior edge 114 and sidewalls so as to retain footboard 120 on sloped platform 110. These retainers may be in addition to a track in platform 110, or may form a track for footboard 120.

Footboard 120 may be configured to slide along a top surface 118 of sloped platform 110. A bottom surface of footboard 120 and top surface of sloped platform 110 may include reduced-friction material, allowing footboard 120 to slide freely on sloped platform 110. Alternatively, footboard 120 may include wheels 122 configured to facilitate the sliding of footboard 120 on sloped platform 110. There may be at least one track disposed in sloped platform 110 for guiding footboard 120 or wheels 122. In yet further embodiments, footboard 120 may be configured to ride along a track disposed in frame 170. In embodiments where footboard 120 rides along a track in frame 170, there may be no need for sloped platform 110.

Gravity may cause the posterior edge of sliding footboard 120 to contact backstop 116 in a resting position. In an exemplary embodiment, sliding footboard 120 may be approximately 24 inches wide and approximately 18 to approximately 20 inches long. The tracks may allow sliding footboard 120 to travel approximately 12 inches to approximately 24 inches in a forward or backward direction.

Raised support structures 130 may be incorporated in a separate frame 170 or may be disposed on sloped platform 110. In an exemplary embodiment, raised support structures 130 may be approximately 48 inches high and may be located approximately two thirds of the length of sloped platform 110 from edge 112. As provided in FIG. 1, raised support structures 130 may project from a top surface 118 of sloped platform 110. In such embodiments, sloped platform 110 and raised support structures 130 may be sized and configured so as not to impede the movement of footboard 120. Alternatively, raised support structures 130 may be attached to the sides of platform 110. Raised support structures 130 may be utilized to support rotating arm assemblies 140. Arm assemblies 140 may be rotatably coupled to support structures 130. In an exemplary embodiment, arm assemblies 140 and support structures 130 may be rotatably coupled by axle 138. Axle 138 may be inserted through an axle hole in both support structures 130 and arm assemblies 140 and secured by a nut or similar securing device affixed to its distal ends. Alternatively, axle 138 may be affixed in a stationary position in either support structures 130 or arm assemblies 140. Axle 138 may then be rotatably inserted in an axle hole disposed in the other of the support structures 130 or arm assemblies 140. A nut or similar securing device may then be affixed to the distal end of axle 138 so as to rotatably couple support structures 130 and arm assemblies 140. Given that support structures 130 may be affixed to platform 110 or a separate frame, the rotatable coupling may allow arm assemblies 140 to rotate in relation to support structures 130.

The orientation of axle 138, support structures 130, and arm assemblies 140 may be such that arm assemblies 140 rotate about a skewed axis. More specifically, from a user's point of view, axles 138 may extend laterally outward, exiting anteriorly from the starting point. The angle may be approximately 20 degrees in an exemplary embodiment. Axles 138 may also extend along a vertical angle, exiting more superiorly. The vertical angle may also be approximately 20 degrees in an exemplary embodiment. Consequently, the axles may form a skewed axis of rotation such that the arm assemblies 140 rotate downward and outward when used as described below. Support structures 130 may be shaped to facilitate the axis of rotation for arm assemblies 140. In some alternative embodiments, shims 192 may also be used to provide a desired angle for rotatably affixing arm assemblies 140.

Arm assemblies 140 may be configured to support paddle members 150. Paddle members 150 may include a substantially cylindrical shaft portion 152 and a handle portion 154. In some exemplary embodiments, handle portions 154 may be elongated members orientated substantially parallel to an axis of rotation. In an exemplary embodiment, a simulated height of paddle members 150 may be adjustable by sliding shaft portion 152 through arm assemblies 140. Shaft portion may be adjustably secured in arm assemblies 140 by a set screw assembly or adjusting pin assembly, wherein shaft portion 152 may have a series of holes disposed perpendicularly to its longitudinal axis that may be configured to align with corresponding holes or gaps in arm assemblies 140 and to receive an adjusting pin.

Activator 100 may include a tensioner support structure 160 disposed proximate an anterior edge 114 of activator 100/platform 110. In some exemplary embodiments, tensioner support structure may be incorporated in frame 170. Tensioners 162 may run from tensioner support structure 160 to arm assemblies 140, applying force on arm assemblies 140. The force may hold arm assemblies 140 in a desired orientation at rest and may provide resistance when a user attempts to manipulate arm assemblies 140. Tensioner support structure 160 may be higher than arm assemblies 140. This may allow tensioners 162 to hold arm assemblies 140 in a desired orientation. In alternative exemplary embodiments, tensioners 162 may secure to a tensioner support structure or location on frame 170 posterior to arm assemblies 140. For example, tensioners 162 may connect a top edge of horizontal members 178, posterior to arm assemblies 140, with a posterior superior aspect of rotatable arm assemblies 140. In such an embodiment, tensioners 162 may run above axel 138, providing upward rotational tension on arm assemblies 140. Tensioners 162 may include springs, elastic bands, pulley systems, hydraulic actuated tensioners, or the like, as would be understood by a person having ordinary skill in the art. In an exemplary embodiment, tensioners 162 may extend from a central point along the anterior edge of activator 100. This may facilitate smooth tension along the arm assemblies' skewed axis of rotation. Tensioners 162 may be secured to arm assemblies 140 and frame 170 or tensioner support structure 160 in a variety of ways as would be understood by a person having ordinary skill in the art, such as welding or the use of fasteners including bolts, screws, nails, staples, hooks, straps, ties, and the like.

Figure 2:
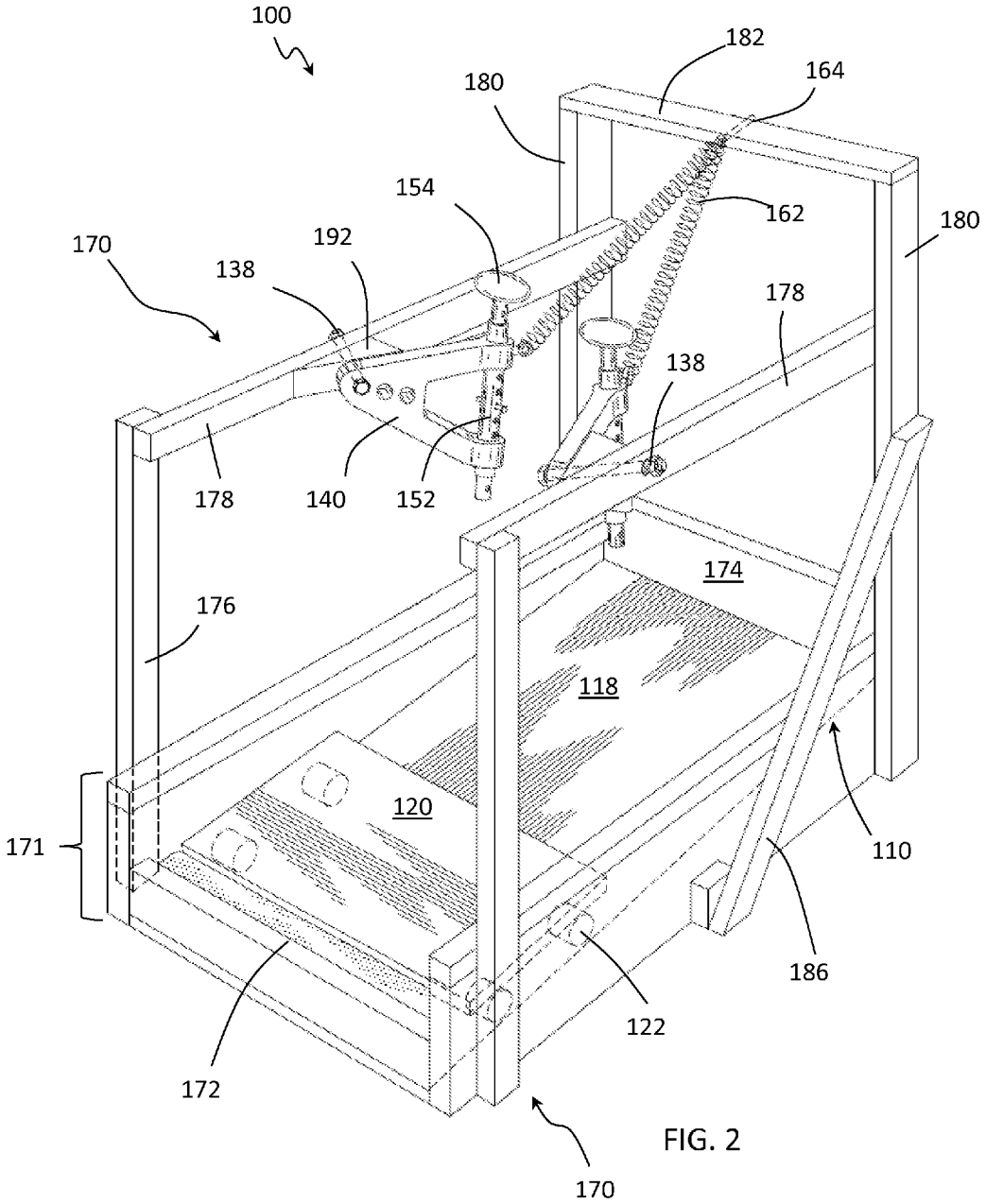
FIG. 2 shows a perspective view of a second exemplary embodiment of a standup paddle board core activator.
Figure 3:
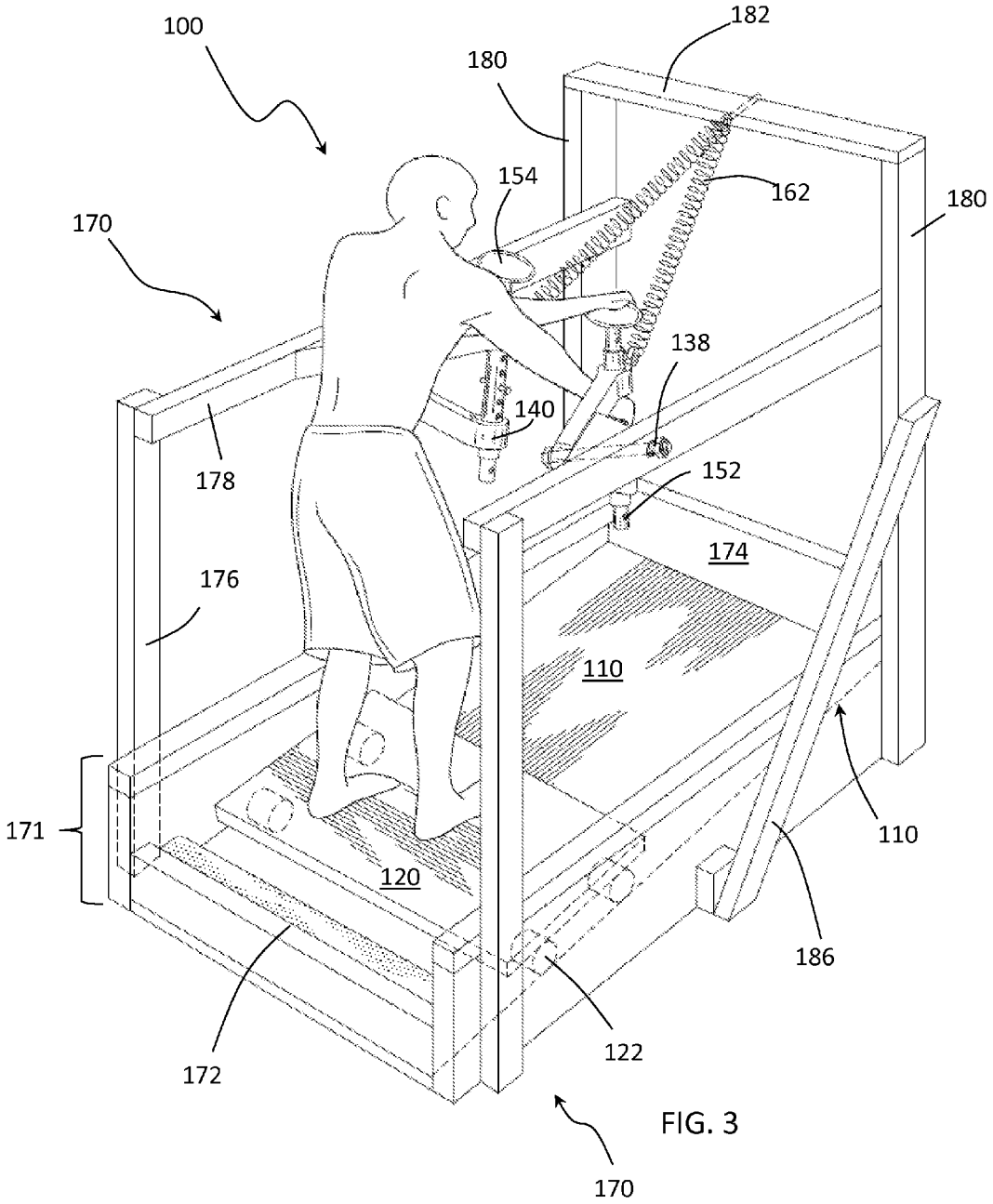
FIG. 3 shows a perspective view of a user on an exemplary embodiment of a standup paddle board core activator.
Figure 4:
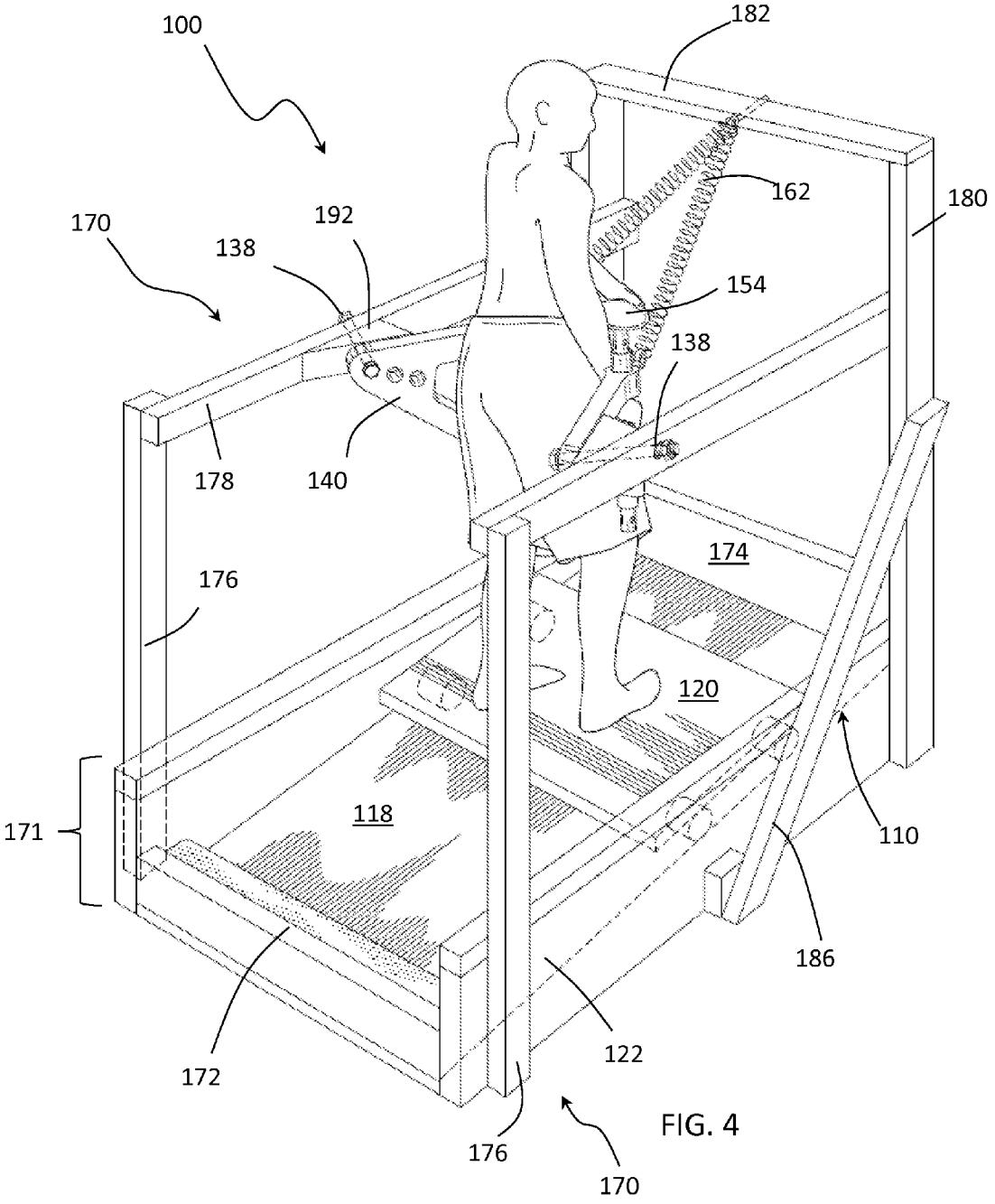
FIG. 4 shows a perspective view of a user on an exemplary embodiment of a standup paddle board core activator.

Referring to exemplary FIGS. 2-4, a separate frame 170 may be provided. Frame 170 may incorporate backstop 116, raised support structures 130, and tensioner support structure 160. In an exemplary embodiment, frame 170 may include a substantially box-shaped base 171 with a posterior member 172 and an anterior member 174. A sloped platform 110 may be disposed within base 171, or a sloped track 192 for footboard 120 may be provided along the side members of base 171. Posterior member 172 may be configured to function substantially similar to backstop 116. In some exemplary embodiments, anterior member 174 may be configured to function as a backstop for footboard 120. In alternative exemplary embodiments, footboard 120 may not travel the full length of frame 170, preventing footboard 120 from interacting with anterior member 174. Frame 170 may additionally include posterior vertical support members 176 and anterior vertical support members 180, which may project upward from the corners of the substantially box-shaped base 171. Anterior vertical support members 180 may be taller than posterior vertical support members 176. Horizontal support members 178 may connect a top portion of posterior vertical support members 176 with adjacent anterior vertical support members 180. In an exemplary embodiment, horizontal support members 178 may be adjustable in a vertical orientation so as to accommodate various users' heights. Arm assemblies 140 may be rotatably secured to horizontal support members 178. Shims 192 may be used to create a desired orientation of axles 138 to provide the appropriate axis of rotation for arm assemblies 140. Horizontal support member 182 may connect the tops of anterior vertical support members 180. Horizontal support member 182 may further serve as a tensioner support structure. Additional support arms 186 may be provided to supply additional strength to frame 170. In some exemplary embodiments, additional support arms 186 may be manipulated to adjust the slope of platform 110 or track 192, as would be understood by a person of ordinary skill in the art.

In such an embodiment, support arms 186 may provide at least one rung for supporting platform 110. Support arms 186 may manipulate the slope of platform 110 by adjusting the at least one rung, or by supporting platform 110 on a different rung.

Figure 5:
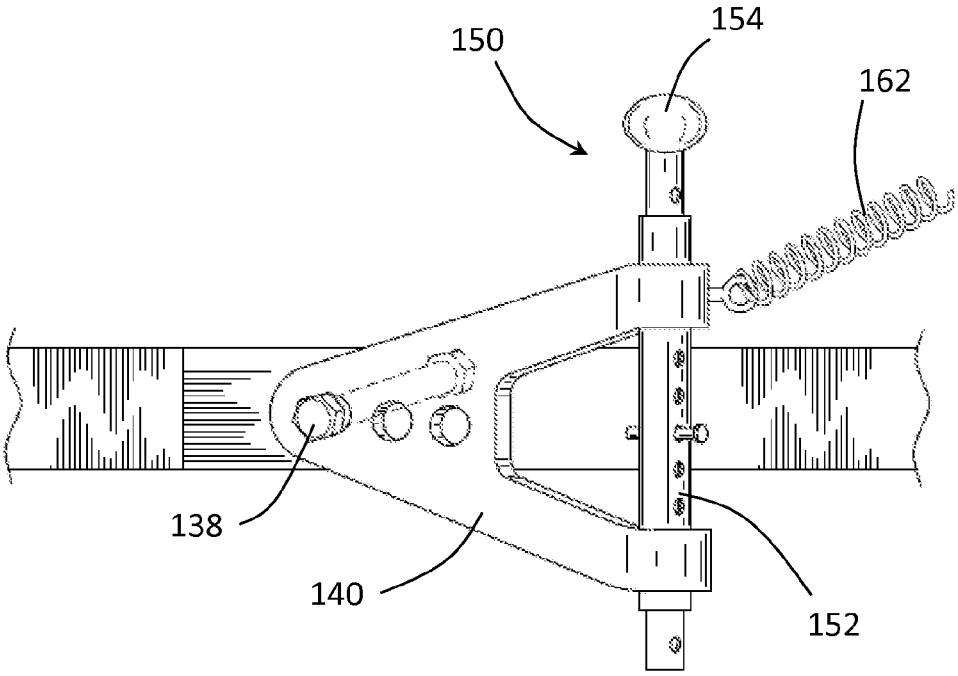
FIG. 5 shows a side view of an arm assembly and paddle member.
Figure 6:
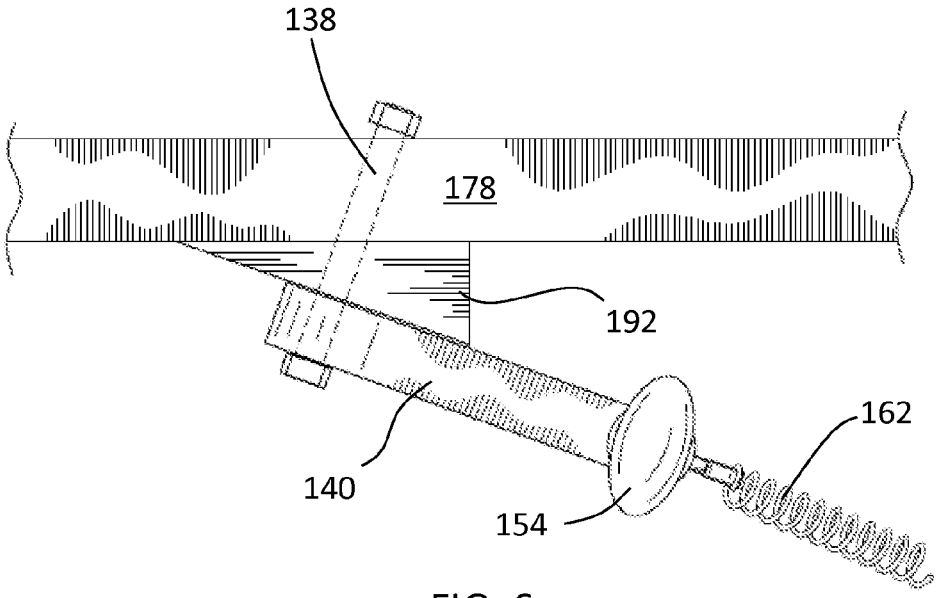
FIG. 6 shows a top view of an arm assembly and paddle member.

As shown in exemplary FIGS. 5-6, arm assemblies 140 may be substantially V-shaped. Arm assemblies 140 may have at least one axle cavity disposed proximate an apex thereof. The at least one axle cavity may be disposed perpendicular to the face of the V-shape. In an exemplary embodiment, there may be multiple axle holes positioned in a line from the apex of the V-shape toward a midpoint in the V-shape so as to allow for adjustment in the radius of rotation and height of the rotatable arm. In an exemplary embodiment, arm assemblies 140 may have paddle shaft receiving holes incorporated in the distal ends of the V-shape. The shaft receiving holes may be configured such that when a paddle shaft 152 is inserted, it connects the distal ends of the V-shape, forming a triangle. In some alternative embodiments, arm assemblies 140 may already be triangular, having paddle shaft receiving brackets disposed at points distal from axle 138. As would be understood by a person having ordinary skill in the art, other variations on the shape and size of arm assemblies 140 may be used without affecting the functionality of the device. As discussed above, the height of shaft members 152 may be adjusted in an exemplary embodiment. Tensioner 162 may be secured to arm assemblies 140 proximate an anterior end opposite axle 138. An anterior end may be determined by allowing the arm assembly to hang freely. In an exemplary embodiment, gravity may force the V-shape to hang upside down. Therefore an anterior end opposite axle 138 would be the end of the V-member closest to the anterior edge 114 of activator 100. When tensioner 162 is connected, force may be applied on arm assembly 140 such that paddle member 150 is held in vertical orientation. Paddle member 150 may be inserted such that handle member 154 is on top, leaving paddle member 150 in an upright orientation.

An exemplary embodiment of activator 100 may operate as follows. A user may adjust the incline of sloped platform 110 or the footboard 120 track in frame 170 to a desired level. The user may also adjust the tension of tensioners 162 to a desired level. The user may then stand in a balanced position on sliding footboard 120. In an exemplary balanced position, the user may position his or her feet approximately shoulder width apart. The feet may be approximately the same depth along the length of footboard 120, or alternatively, one foot may be in a more forward or backward position. Variations to stance may be used to exercise different muscles.

The user may grasp a handle 154 with an opposite hand using an overhand grip. For example, the user may grasp the handle 154 on the left side of core activator 100 with the user's right hand. The user may then grasp the shaft member 152 on the same side as the grasped handle 154 with the user's other hand. The shaft member 152 may be grasped at a comfortable height. In an exemplary embodiment, this may be approximately 18 to approximately 24 inches below the handle 154. The user may then slide the footboard 120 upward along the track or platform 110. This may predominantly utilize the user's abdominal muscles. Pressure applied by the user on handle 154 and shaft 152 may cause handle assembly 140 to rotate downward, backward, and outward along the skewed axis. With the resistance from tensioner 162, the arm assembly 140 may rotate approximately ⅛ to approximately ¼ of a rotation. This may utilize the user's deltoid and latissimus dorsi musculature. The user may slide the footboard 120 approximately 12 to approximately 24 inches along the slope. Once footboard 120 has stopped its forward progress, the user may allow the activator 100 to return to its starting position, facilitated by gravity and the force of tensioners 162. This process may be repeated and may be performed using either side (either arm/handle assembly).

Variations on the functionality may be contemplated. For example, changes in stance and orientation may focus exercise on different muscle groups. In at least one variation, a user may rest both forearms on a top edge of arm assemblies 140 or grasp handles 154 with each respective hand (right handle with right hand, etc.). The user may then slide footboard 120 along the slope without the upper body twist utilized when a right hand grasps the left handle 154.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A standup paddle board core activator device comprising:

a footboard configured to slide along one of a sloped surface, a track, or a reduced friction material to facilitate a sliding footboard;

a raised support structure;

at least one arm assembly rotatably secured to a first member of the raised support structure wherein the at least one arm assembly has at least one axle extending laterally outward and at a vertical angle, the at least one arm assembly configured to rotate about a skewed axis of rotation of the at least one axle relative to a horizontal and vertical axis of the first member of the raised support structure;

at least one tensioner extending from the at least one arm assembly to a tensioner support structure; and at least one paddle member affixed to the arm assembly, wherein the paddle member further comprises a shaft portion and handle portion.

2. The device of claim 1, wherein the raised support structure and tensioner support structure are incorporated in an exterior frame.

3. The device of claim 1, further comprising at least one wheel to facilitate sliding of the footboard along one of the sloped surface or track.

4. The device of claim 1, further comprising a backstop configured to retain the footboard on the sloped surface or track, wherein the backstop is made of rubber.

5. The device of claim 1, wherein an angle of incline of the sloped surface, track, or reduced friction material is adjustable.

6. The device of claim 1, wherein the height of the at least one paddle member with relation to the at least one arm assembly is adjustable.

7. A method of exercising comprising:

providing a standup paddle board core activator device, wherein the device comprises a footboard configured to slide along one of a sloped surface or track, a raised support structure, at least one arm assembly rotatably secured to the raised support structure, at least one tensioner extending from the at least one arm assembly to a tensioner support structure, and at least one paddle member affixed to the arm assembly, wherein the at least one paddle member further comprises a shaft portion and handle portion;

standing on the footboard facing substantially forward with feet approximately shoulder width apart;

reaching with one hand across a user's body to grasp the handle portion of the at least one paddle member of the device on an opposite side of the user's body;

grasping the shaft member below the handle member with the user's free hand;

sliding the footboard up the sloped platform or track;

allowing gravity to return the footboard to a resting position;

simultaneously allowing the at least one tensioner to return the at least one arm assembly and the at least one paddle member to a resting orientation; and repeating as desired.

8. A method of exercising comprising:

providing a standup paddle board core activator device, wherein the device comprises a footboard configured to slide along one of a sloped surface or track, a raised support structure, two arm assemblies rotatably secured to the raised support structure, a tensioner extending from each of the two arm assemblies to a tensioner support structure, and a paddle member affixed to each arm assembly, wherein the paddle member further comprises a shaft portion and handle portion;

standing on the footboard facing substantially forward with feet approximately shoulder width apart;

reaching at least one hand forward such that one's forearms rest along a top surface of each arm assembly, respectively;

grasping at least one of the handle portions with at least one hand, respectively;

sliding the footboard up the sloped platform or track;

allowing gravity to return the footboard to a resting position;

simultaneously allowing the tensioners to return the arm assemblies and paddle member to a resting orientation; and repeating as desired.

* * * * *